US007677913B1

(12) United States Patent
Yang

(10) Patent No.: US 7,677,913 B1
(45) Date of Patent: Mar. 16, 2010

(54) PLUG-TYPE CONNECTOR

(75) Inventor: Haven Yang, Chung Ho (TW)

(73) Assignee: All Best Electronics Co., Ltd. (TW)

( * ) Notice: Subject to any disclaimer, the term of this patent is extended or adjusted under 35 U.S.C. 154(b) by 0 days.

(21) Appl. No.: 12/477,236

(22) Filed: Jun. 3, 2009

(51) Int. Cl.
*H01R 13/627* (2006.01)

(52) U.S. Cl. ..... 439/358; 439/541.5; 439/372

(58) Field of Classification Search ..... 439/352–354, 439/357–358, 372, 540.1, 541.5
See application file for complete search history.

(56) References Cited

U.S. PATENT DOCUMENTS 6,641,424 B1 * 11/2003 Hanak et al. ..... 439/352
6,821,139 B1 * 11/2004 Wu ..... 439/352
6,866,533 B2 * 3/2005 Wu ..... 439/352
7,118,403 B1 * 10/2006 Drye et al. ..... 439/352
7,381,078 B2 * 6/2008 Mtchedlishvili et al. .... 439/352

* cited by examiner

*Primary Examiner*—Khiem Nguyen
(74) *Attorney, Agent, or Firm*—Schmeiser, Olsen & Watts, LLP

(57) ABSTRACT

A plug-type connector includes a connector main body having a first end formed into a plug portion and an opposite second end formed into a pull portion; a pinch unit movably coupled to the pull portion, and having at least a vertical plate corresponding to an end face of the pull portion and a pinch plate perpendicularly extended from the vertical plate and corresponding to a back face of the pull portion; and an elastic element located between the back face of the pull portion and the pinch plate. Two plug-type connectors can be plugged in a two-leveled housing back to back. The connector main bodies are normally firmly connected to the housing by the pinch units, and any one of the two connector main bodies can be easily removed from the housing simply by pulling the pinch unit thereof without being interfered by the other pinch unit.

4 Claims, 6 Drawing Sheets a

A-A

B-B a

PLUG-TYPE CONNECTOR

FIELD OF THE INVENTION

The present invention relates to improvements made to a plug-type connector, and more particularly to a plug-type connector that can be firmly plugged in a two-leveled housing for use and be easily removed from the housing without being interfered by another plug-type connector in the housing.

BACKGROUND OF THE INVENTION

A conventional plug-type connector 5 as shown in FIGS. 1 and 2 includes a plug portion 51 formed at one end and a pull portion 52 formed at the other end thereof. A pinch plate 53 is movably provided to a back of the pull portion 52. Two pieces of the plug-type connector 5 can be simultaneously plugged in a two-leveled housing 6 back to back. By operating the pinch plates 53, the pull portions 52 of the plug-type connectors 5 can be firmly coupled to the two-leveled housing 6 or removed from the housing 6.

As having been mentioned above, the pinch plate 53 is located at the back of the pull portion 52. Therefore, when two plug-type connectors 5 are plugged in the two-leveled housing 6 back to back, the pinch plates 53 thereof would contact with each other at distal ends thereof. When it is desired to remove any one of the two plug-type connectors 5 from the housing 6 by pulling the pinch plate 53, the mutually contacting pinch plates 53 would prevent a user from conveniently pulling the desired pinch plate 53, and accordingly, it is uneasy to remove the plug-type connector 5 from the housing 6.

It is therefore tried by the inventor to develop an improved plug-type connector that can be easily plugged into and removed from a two-leveled connector housing.

SUMMARY OF THE INVENTION

A primary object of the present invention is to provide an improved plug-type connector having a pinch unit, such that two of such plug-type connectors can be simultaneously plugged in a two-leveled housing back to back and be firmly coupled thereto by the pinch units for use, and any one of the two plug-type connectors can be easily removed from the housing simply by pulling the pinch unit thereof without being interfered by the other pinch unit.

To achieve the above and other objects, the plug-type connector according to the present invention includes a connector main body having a first end formed into a plug portion and an opposite second end formed into a pull portion; a pinch unit movably coupled to the pull portion, and having at least a vertical plate corresponding to an end face of the pull portion and a pinch plate perpendicularly extended from the vertical plate and corresponding to a back face of the pull portion; and an elastic element located between the back face of the pull portion and the pinch plate.

With the above arrangements, two plug-type connectors of the present invention can be simultaneously plugged in a two-leveled housing back to back. The connector main bodies are normally firmly connected to the housing by the pinch units, and any one of the two connector main bodies can be easily removed from the housing simply by pulling the pinch unit thereof without being interfered by the other pinch unit.

BRIEF DESCRIPTION OF THE DRAWINGS

The structure and the technical means adopted by the present invention to achieve the above and other objects can be best understood by referring to the following detailed description of the preferred embodiments and the accompanying drawings, wherein.

DETAILED DESCRIPTION OF THE PREFERRED EMBODIMENTS

Figure 1:
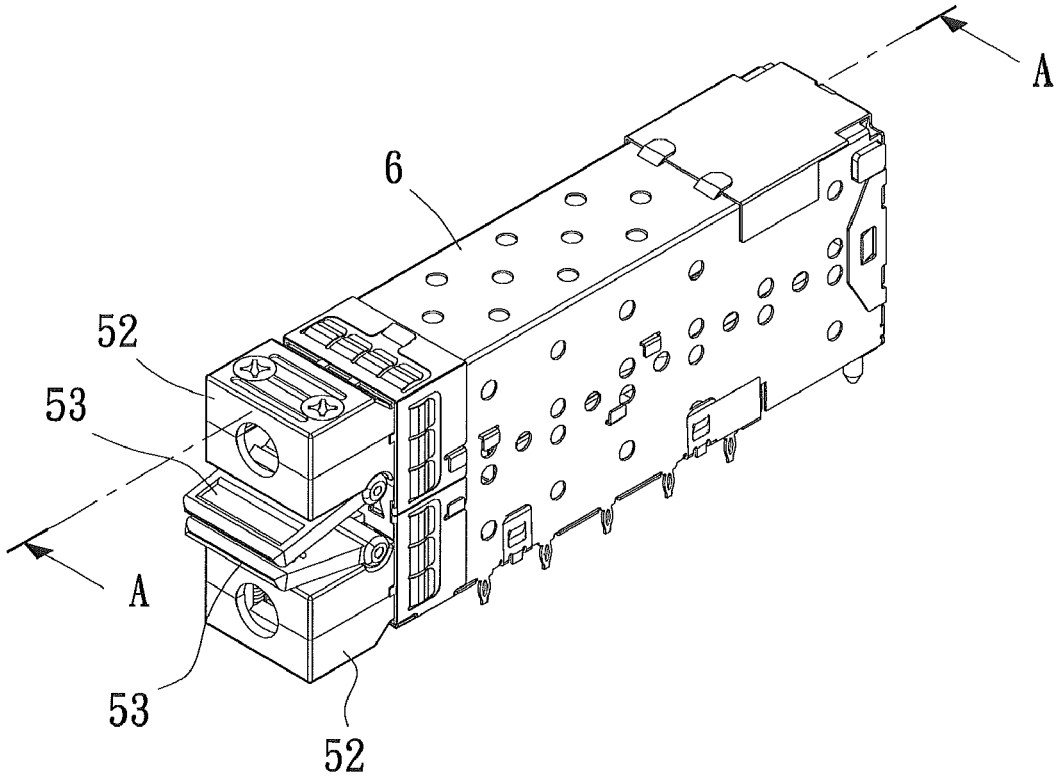
(PRIOR ART) Fig. 1
FIG. 1 is a perspective view showing two conventional plug-type connectors are plugged in a two-leveled housing back to back for use.
Figure 2:
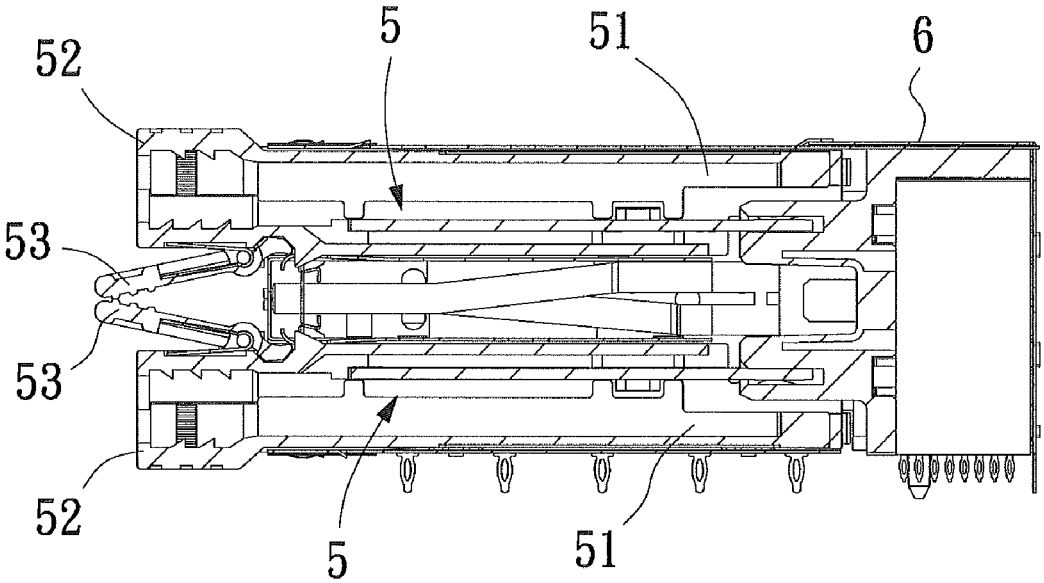
(PRIOR ART) Fig. 2
FIG. 2 is a sectional view taken along line A-A of FIG. 1.
Figure 3:
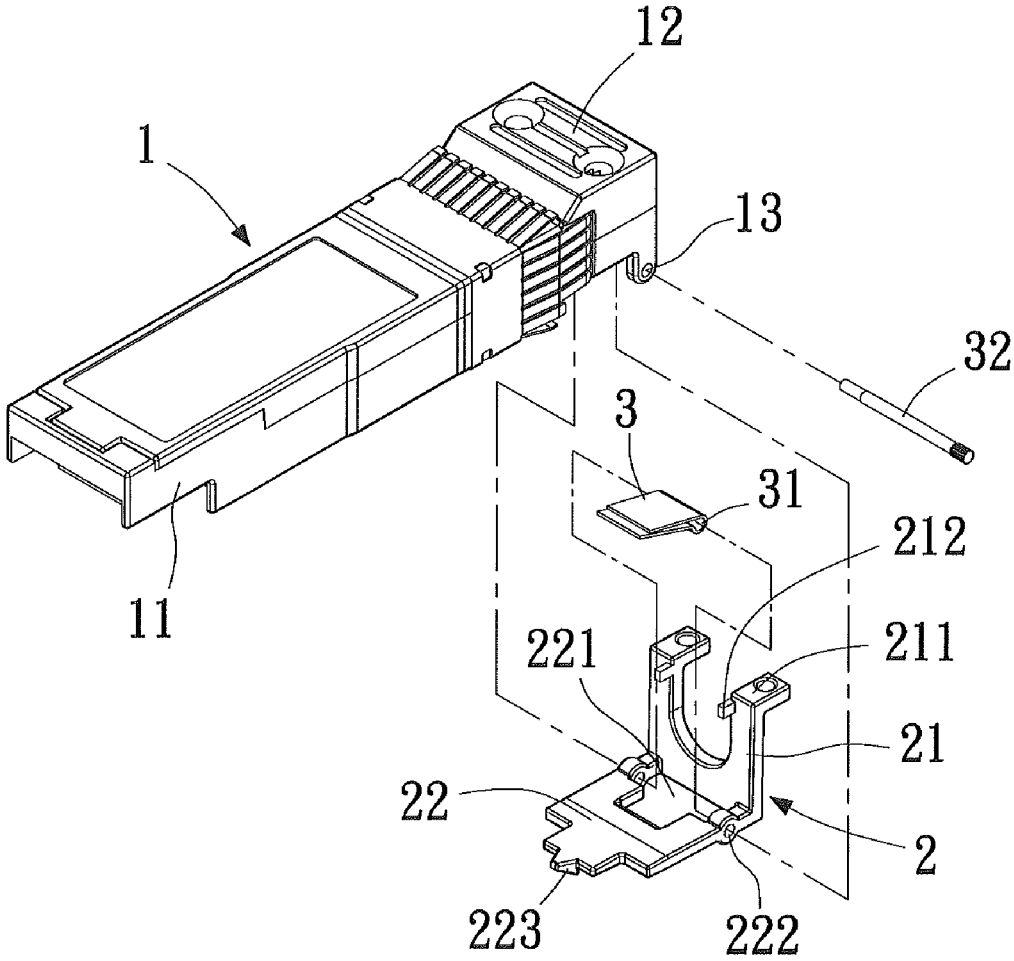
FIG. 3 is an exploded perspective view of a plug-type connector according to an embodiment of the present invention.
Figure 4:
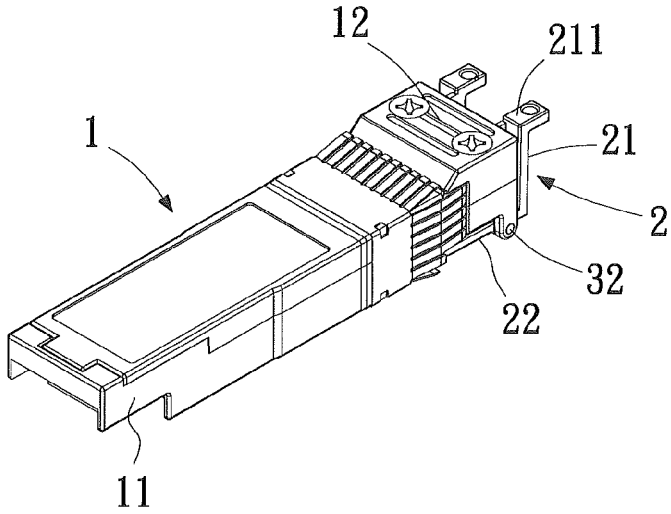
FIG. 4 is an assembled view of FIG. 3.

Please refer to FIGS. 3 and 4 that are exploded and assembled perspective views, respectively, of a plug-type connector according to an embodiment of the present invention. As shown, the plug-type connector includes at least a connector main body 1, a pinch unit 2, and an elastic element 3.

The connector main body 1 has a first end formed into a plug portion 11 and an opposite second end formed into a pull portion 12. The pull portion 12 is provided on a back face at two lateral sides thereof with a pivot portion 13 each.

The pinch unit 2 is movably connected to the pull portion 12 of the connector main body 1, and includes a vertical plate 21 corresponding to an end face of the pull portion 12 and a pinch plate 22 perpendicularly extended from the vertical plate 21 and corresponding to the back face of the pull portion 12. The vertical plate 21 is provided at a free end with a pull section 211. Two press blocks 212 are spaced on one face of the vertical plate 21 facing toward the end face of the pull portion 12. A notch 221 is formed on the pinch plate 22. Two shaft holes 222 are separately formed at two lateral sides of the notch 221 corresponding to the two pivot portions 13. And, a hook 223 is formed at a distal end of the pinch plate 22.

The elastic element 3 is located between the back face of the pull portion 12 and the pinch plate 22. An end of the elastic element 3 is formed into a sleeve 31, which is located in the notch 221 to align with the two shaft holes 222. And, a shaft 32 is extended through the sleeve 31 with two opposite ends of the shaft 32 received in the pivot portions 13 and the shaft holes 222.

Figure 5:
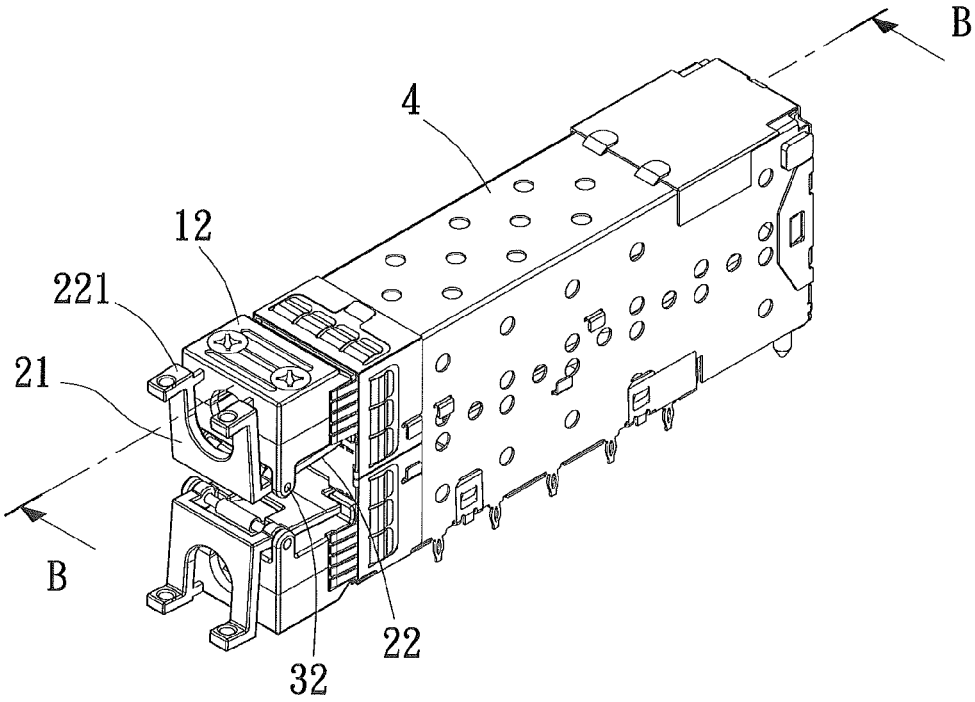
FIG. 5 is a perspective view showing two plug-type connectors of the present invention are plugged in a two-leveled housing back to back for use.
Figure 6:
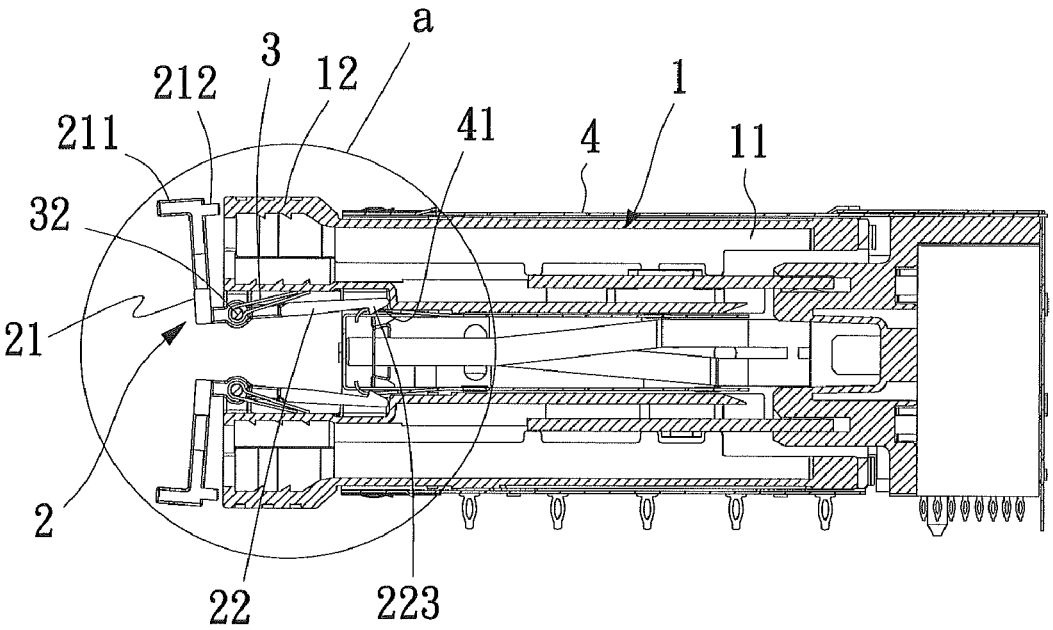
FIG. 6 is a sectional view taken along line B-B of FIG. 5.
Figure 7:
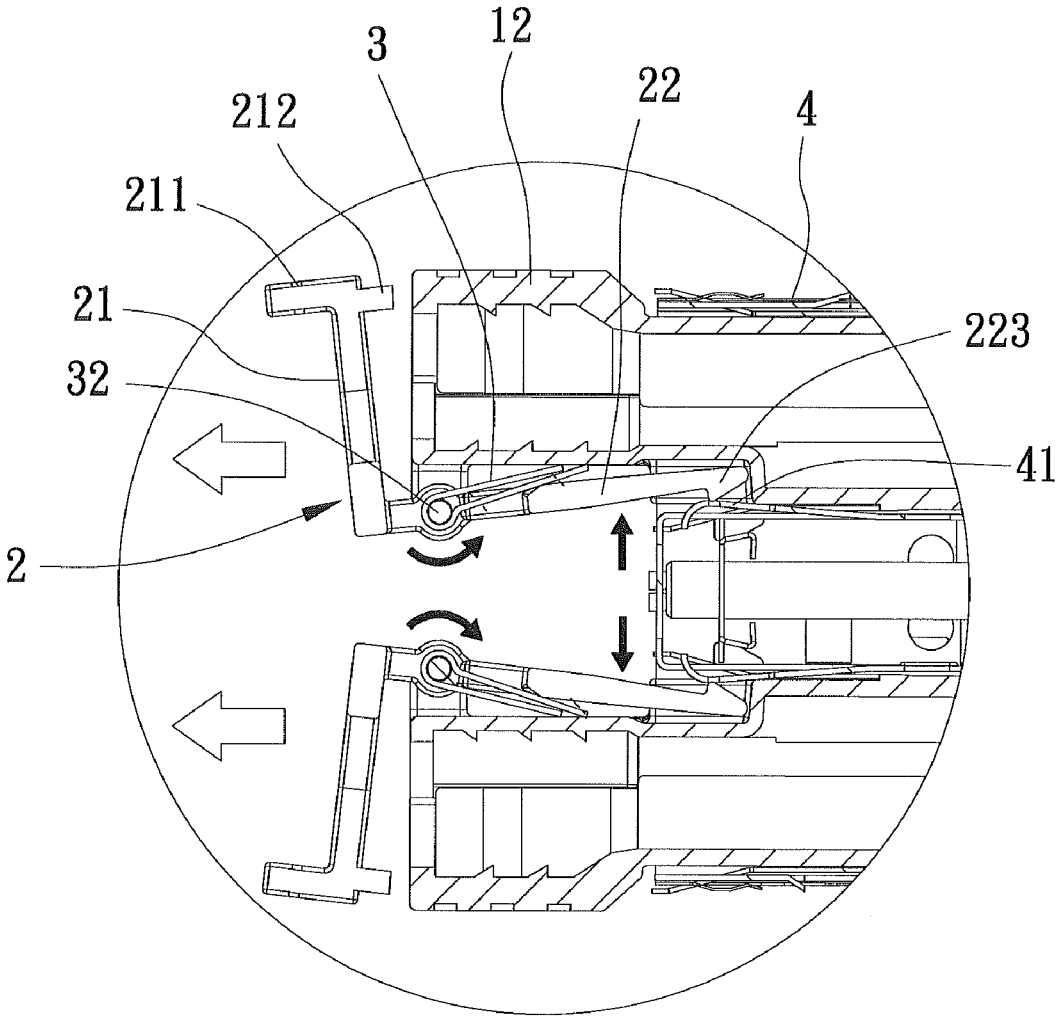
FIG. 7 is an enlarged view of the circled area "a" of FIG. 6.

FIG. 5 is an assembled perspective view showing an application of the plug-type connector of the present invention, FIG. 6 is a sectional view taken along line B-B of FIG. 5, and FIG. 7 is an enlarged view of the circled area "a" of FIG. 6. Please refer to FIGS. 5, 6 and 7 at the same time. Two pieces of the plug-type connector of the present invention can be simultaneously plugged in a two-leveled connector housing 4 back to back, so that the plug portions 11 of the connector main bodies 1 of the two plug-type connectors are received in the housing 4 with the elastic elements 3 elastically pushing against the pinch plates 22 of the pinch units 2, forcing the hooks 223 at the distal ends of the two pinch plates 22 to hook to two retaining holes 41 provided in the two-leveled housing 4. At this point, the press blocks 212 on the vertical plates 21 of the pinch units 2 are pressed against the end faces of the pull portions 12, and the two connector main bodies 1 are firmly coupled to the two-leveled housing 4 via the pinch units 2 for use. When it is desired to remove any of the two connector main bodies 1 from the housing 4, simply apply an external pull force on the pull section 211 at the free end of the vertical plate 21, so that the vertical plate 21 brings the pinch plate 22 to compress against the elastic element 3 and release the hook 223 from the retaining hole 41. At this point, the connector main body 1 can be removed from the two-leveled housing 4. Since the vertical plates 21 are facing toward the end faces of the pull portions 12 without interfering with each other, a user can easily remove or unplug any of the connector main bodies 1 from either an upper level or a lower level in the housing 4 simply by pulling the pull section 211 of the vertical plate 21 thereof.

With the above arrangements, the connector main bodies 1 of two plug-type connectors according to the present invention can be simultaneously plugged in a two-leveled housing 4 back to back, and the pinch units 2 not only enable firm connection of the connector main bodies 1 to the housing 4, but also enable easy removal of the two connector main bodies 1 from the housing 4 without being interfered by each other. Therefore, the plug-type connector of the present invention is novel and industrially practical for use, and any product derived from the present invention is believed to fully satisfy the market demands.

The present invention has been described with a preferred embodiment thereof and it is understood that many changes and modifications in the described embodiment can be carried out without departing from the scope and the spirit of the invention that is intended to be limited only by the appended claims.

What is claimed is:

1. A plug-type connector, comprising:

a connector main body having a first end formed into a plug portion and an opposite second end formed into a pull portion;

a pinch unit being movably coupled to the pull portion of the connector main body, and including a vertical plate corresponding to an end face of the pull portion and a pinch plate perpendicularly extended from the vertical plate and corresponding to a back face of the pull portion; and an elastic element being located between the back face of the pull portion and the pinch plate.

2. The plug-type connector as claimed in claim 1, wherein the pull portion is provided on the back face at two lateral sides thereof with a pivot portion each; the pinch plate is provided with a notch, which is provided at two lateral sides with two shaft holes corresponding to the pivot portions; and the elastic element has an end formed into a sleeve, which is located in the notch to align with the two shaft holes and has a shaft extended therethrough with two opposite ends of the shaft received in the pivot portions and the shaft holes.

3. The plug-type connector as claimed in claim 1, wherein the vertical plate is provided on a free end with a pull section, and press blocks are spaced on a face of the vertical plate facing toward the end face of the pull portion.

4. The plug-type connector as claimed in claim 1, wherein the pinch plate is provided at a distal end with a hook.

* * * * *